US008960508B2

(12) United States Patent
Funato et al.

(10) Patent No.: US 8,960,508 B2
(45) Date of Patent: Feb. 24, 2015

(54) SLIDING NOZZLE DEVICE

(75) Inventors: Junichi Funato, Kitakyushu (JP); Hiroyuki Tofuku, Kitakyushu (JP); Yasuo Kawano, Kitakyushu (JP); Shinjiro Saito, Kitakyushu (JP)

(73) Assignee: Krosaki Harima Corporation, Kitakyushu-shi (JP)

( * ) Notice: Subject to any disclaimer, the term of this patent is extended or adjusted under 35 U.S.C. 154(b) by 589 days.

(21) Appl. No.: 12/990,820

(22) PCT Filed: May 15, 2009

(86) PCT No.: PCT/JP2009/059087

§ 371 (c)(1), (2), (4) Date: Jan. 20, 2011

(87) PCT Pub. No.: WO2009/139471

PCT Pub. Date: Nov. 19, 2009

(65) Prior Publication Data

US 2011/0101041 A1 May 5, 2011

(30) Foreign Application Priority Data

May 16, 2008 (JP) ..... 2008-129995

(51) Int. Cl.
*B22D 41/00* (2006.01)
*B22D 41/34* (2006.01)
(Continued)

(52) U.S. Cl.
CPC ..... *B22D 41/34* (2013.01); *B22D 41/24* (2013.01); *B22D 41/40* (2013.01)
USPC ..... 222/591; 222/600; 266/236

(58) Field of Classification Search
CPC ..... B22D 41/50; B22D 41/22; B22D 41/24; B22D 41/34; B22D 41/40
USPC ..... 222/600, 591, 590, 597, 606, 607; 266/236, 287
See application file for complete search history.

(56) References Cited

U.S. PATENT DOCUMENTS 4,116,372 A * 9/1978 Horiguchi et al. ..... 222/600
6,276,573 B1 * 8/2001 Tofuku et al. ..... 222/600
(Continued)

FOREIGN PATENT DOCUMENTS

JP 52 118308 9/1977
JP 2003 275865 9/2003
(Continued)

OTHER PUBLICATIONS

International Search Report issued Aug. 11, 2009 in PCT/JP09/059087 filed May 15, 2009.
(Continued)

*Primary Examiner* — Scott Kastler
*Assistant Examiner* — Michael Aboagye
(74) *Attorney, Agent, or Firm* — Oblon, Spivak, McClelland, Maier & Neustadt, L.L.P.

(57) ABSTRACT

A sliding nozzle device automatically performs a series of operations of loading and unloading pressure between plates and opening and closing a slide frame; maintaining the pressure without additional operations; and operates at full stroke during molten steel flow control. An auxiliary plate-exchanging mechanism includes slide axes moving in the same direction as a hydraulic cylinder operates, and an arm having a proximal end placed around the slide axis. The plate-exchanging mechanism is fixed on an upside frame. A first engagement pin mounted on the proximal end of the arm is inserted in a first engagement groove in a first engagement member engaging with the slide axis, and second engagement pins mounted on bearings are inserted in second engagement grooves in the slide axes. With movement of the slide axes the engagement pins respectively move in the engagement grooves, thereby rotating the slide axes and the arm.

18 Claims, 14 Drawing Sheets

(51) Int. Cl.
*B22D 41/24* (2006.01)
*B22D 41/40* (2006.01)

(56) References Cited

U.S. PATENT DOCUMENTS

| | | | | |
|---|---|---|---|---|
| 6,382,477 | B1 * | 5/2002 | Yamamoto et al. | 222/600 |
| 7,455,201 | B2 * | 11/2008 | Mitsui et al. | 222/600 |
| 2007/0267591 | A1 | 11/2007 | Mitsui et al. | |
| 2008/0272157 | A1 * | 11/2008 | Kondo et al. | 222/591 |
| 2011/0062193 | A1 | 3/2011 | Sadano et al. | |

FOREIGN PATENT DOCUMENTS

| | | |
|---|---|---|
| JP | 2005 262238 | 9/2005 |
| JP | 2006 136912 | 6/2006 |

OTHER PUBLICATIONS

U.S. Appl. No. 12/810,050, filed Jun. 22, 2010, Tofuku, et al.

* cited by examiner

SLIDING NOZZLE DEVICE

TECHNICAL FIELD

The present invention relates to a sliding nozzle device for controlling flow of molten metal in a molten metal container, and in particular, relates to a sliding nozzle device for reducing workloads of exchanging plates.

BACKGROUND ART

A sliding nozzle device includes a fixed plate and a sliding plate; holding means for holding the fixed plate and the sliding plate, respectively; a sliding means for sliding the sliding plate; and a pressure loading means for loading pressure between the fixed plate and the sliding plate.

Relating to the above pressure loading means, Patent Document 1 discloses a pressure loading member which has a substantially U-shaped cross section and holds a flange and a lower lateral side of a slide case (slide frame). The flange is projecting from a side of a base frame (upside frame) fixed on a bottom of a molten metal container. A compression spring is placed between an upper end of the pressure loading member and an upper surface of the flange of the base frame, and a rail is laid on an upper surface of a lower end of the pressure loading member. Rollers are attached pivotally to both sides of the slide case, and each of the rollers is supported by the rail. When the roller is moved to a slanted portion of the rail formed at a tail end thereof, pressure between the base frame and the slide case is unloaded. Additionally, to prevent the slide case from accidentally moving to the slanted portion during operation, a stopper is provided between the base frame and a rod-connecting portion of the slide case.

The invention disclosed in Patent Document 2 is designed to reduce heavy muscular work under heat as much as possible by facilitating operations for opening and closing a cover (suspending frame) covering a plate. The invention in Patent Document 2 is a device operable to open and close the cover by power of an opening and closing cylinder which serves to slide a lower plate (sliding plate).

PRIOR ART DOCUMENTS

Patent Documents

Patent Document 1: Japanese Unexamined Patent Application Publication No. 2006-136912

Patent Document 2: Japanese Unexamined Patent Application Publication No. 2003-275865

SUMMARY OF INVENTION

Problem to be Solved by the Invention

As for the sliding nozzle device in Patent Document 1, the slanted portion of the rail is not used when the pressure is loaded between the base frame and the slide case, therefore the sliding nozzle device can not be operated at full stroke during control of molten steel flow. In addition, the four rollers rotates under the contact pressure when the plate is slid, therefore heavy loads are applied to the rollers.

The sliding nozzle device in Patent Document 2 requires additional operations, i.e., inserting and removing an engagement pin, for switching operations between (a) loading and unloading the pressure between plates and (b) opening and closing the cover. In addition, a slider (slide frame) has to be slid for every operation, which means that at the time of exchanging the plates, the slider is slid for a total of four operations: unloading the pressure, opening the cover, closing the cover, and loading the pressure.

The present invention has been made in view of the above circumstances and aims to provide a sliding nozzle device, enabling a series of automatic operations of loading and unloading pressure between plates as well as opening and closing a slide frame, keeping the pressure without additional operations, and further operating at full stroke during control of molten steel flow.

Means for Solving Problem

To achieve the above objective, the present invention provides a sliding nozzle device including: an upside frame holding a fixed plate, the upside frame placed at a bottom of a molten metal container; a slide frame holding a sliding plate, the slide frame being openable relative to the upside frame; a sliding means for sliding the slide frame; and a spring box pressing the slide frame against the upside frame, the spring box rotatably fixed to the upside frame; the device comprising: an auxiliary plate-exchanging means interlocking with the sliding means, the auxiliary plate-exchanging means unloading the pressure on the slide frame and rotating the spring box while the sliding means operates in one direction, the auxiliary plate-exchanging means rotating the spring box and pressing the slide frame against the upside frame while the sliding means operates in the other direction.

The present invention also provides a sliding nozzle device including: an upside frame holding a fixed plate, the upside frame placed at a bottom of a molten metal container; a slide frame holding a sliding plate, the slide frame being openable relative to the upside frame; a sliding means for sliding the slide frame; and a spring box pressing the slide frame against the upside frame, the spring box rotatably fixed to the upside frame; the device comprising: an auxiliary plate-exchanging means interlocking with the sliding means; the auxiliary plate-exchanging means unloading the pressure on the slide frame, rotating the spring boxes, and opening the slide frame while the sliding means operates in one direction; the auxiliary plate-exchanging means closing the slide frame, rotating the spring box, and pressing the slide frame against the upside frame while the sliding means operates in the other direction.

The present invention is provided with the auxiliary plate-exchanging means interlocking with the sliding means. While the sliding means operates in one direction, the auxiliary plate-exchanging means unloads the pressure on the slide frame, thereby rotating the spring box. While the sliding means operates in the other direction, the auxiliary plate-exchanging means rotates the spring box, thereby pressing the slide frame against the upside frame. As just described, the pressure between the plates can be automatically loaded and unloaded.

In this regard, the following operations are also possible. While the sliding means operates in one direction, the auxiliary plate-exchanging means unloads the pressure on the slide frame, thereby rotating the spring box and opening the slide frame. While the sliding means operates in the other direction, the auxiliary plate-exchanging means closes the slide frame and then rotates the spring box, thereby pressing the slide frame against the upside frame. Thus, it is possible to automatically perform a series of operations of loading and unloading the pressure between the plates as well as opening and closing the slide frame.

The auxiliary plate-exchanging means may include: a slide axis moving in the same direction as the sliding means; an engagement member engaging with the slide axis, the engagement member fixed on the upside frame; and an arm having a proximal end placed around the slide axis and a distal end connected to the slide frame or the spring box; wherein an engagement pin mounted on the proximal end of the arm is inserted into an engagement groove formed in the engagement member; as the engagement pin moves in the engagement groove according to movement of the slide axis, the arm rotates around the slide axis; and the slide frame or the spring box connected with the arm rotates in an opening or closing direction of the slide frame or the spring box.

In the above configuration, according to the movement of the slide axis, the engagement pin mounted on the proximal end of the arm moves along the engagement groove formed in the engagement member. This produces a force acting on the arm in a circumferential direction, enabling the arm to rotate. Consequently, the slide frame is opened and closed or the spring box is rotated.

The auxiliary plate-exchanging means may include: a slide axis moving in the same direction as the sliding means; an engagement member engaging with the slide axis, the engagement member fixed on the upside frame; and an outer tube having the spring box or the slide frame fixed thereon, the outer tube placed around the slide axis, the outer tube rotating according to rotation of the slide axis; and wherein an engagement pin mounted on the engagement member is inserted into an engagement groove formed in the slide axis; according to movement of the slide axis, the engagement pin moves in the engagement groove, and the slide axis rotates; and according to the rotation of the slide axis, the outer tube rotates, and the spring box or the slide frame rotates in an opening or closing direction of the spring box or the slide frame.

In the above configuration, according to the movement of the slide axis, the engagement pin mounted on the engagement member moves along the engagement groove formed in the slide axis. This produces a force acting on the slide axis in a circumferential direction, enabling the slide axis to rotate. Consequently, the slide frame is opened and closed or the spring box is rotated.

The auxiliary plate-exchanging means may include: a slide axis moving in the same direction as the sliding means; an engagement member engaging with the slide axis, the engagement member fixed on the upside frame; and an outer tube having the spring box or the slide frame fixed thereon, the outer tube placed around the slide axis, the outer tube rotating according to rotation of the slide axis; wherein an engagement pin mounted on the slide axis is inserted into an engagement groove formed in the engagement member; according to movement of the slide axis, the engagement pin moves in the engagement groove, and the slide axis rotates; and according to the rotation of the slide axis, the outer tube rotates, and the spring box or the slide frame rotates in an opening or closing direction of the spring box or the slide frame.

In the above configuration, according to the movement of the slide axis, the engagement pin mounted on the slide axis moves along the engagement groove formed in the engagement member. This produces a force acting on the slide axis in a circumferential direction, enabling the slide axis to rotate. Consequently, the slide frame is opened and closed or the spring box is rotated.

A rack gear may be mounted on and along the slide axis; a pinion gear may be mounted on a press screw, the pinion gear engaging with the rack gear, the press screw compressing a spring placed inside the spring box or releasing the compression of the spring; and according to the movement of the slide axis, the press screw may rotate to compress the spring or to release the compression of the spring.

In the above configuration, the rack and pinion mechanism converts movement of the slide axis into rotation of the press screw in the spring box. In this way, the spring placed inside the spring box is compressed or the compression of the spring is released, thereby automatically loading and unloading the pressure between the plates.

The auxiliary plate-exchanging means may have an contact portion to be contacted by the sliding means; the sliding means operates in the other direction and contacts with the contact portion, and the slide axis moves in the other direction; and the auxiliary plate-exchanging means is connected to the sliding means by an connecting jig, thereby the sliding means operates in the one direction, and the sliding axis moves in the one direction.

In the present invention, the following directions are preliminary determined: (a) a direction in which the slide axis moves to unload the pressure on the slide frame, rotate the spring box, and open the slide frame; and (b) a direction in which the slide axis moves to close the slide frame, rotate the spring box, and press the slide frame against the upside frame. In this specification, as a matter of convenience, the above direction (a) is referred to as "one direction," and the opposite direction is referred to as "the other direction."

In the present invention, the sliding means operates in the other direction and contacts with the contact portion of the auxiliary plate-exchanging means, then the slide axis moves to the other direction and the slide frame is closed, and further the spring box rotates and the slide frame is pressed against the upside frame. The auxiliary plate-exchanging means and the sliding means are not connected to each other, thus the pressure between the plates is not released even if the sliding means operates in one direction thereafter. For this reason, the present invention can prevent the pressure between the plates from being unloaded accidentally, and further the sliding nozzle device can operate at full stroke during controlling molten steel flow. Only when the pressure between the plates needs to be unloaded, the auxiliary plate-exchanging means and the sliding means are connected to each other by the connecting jig, and the sliding means operates in one direction.

It is also possible to provide a safety lever contacting with the connecting jig, thereby rotating in one direction, the connecting jig connecting the auxiliary plate-exchanging means with the sliding means. This configuration can prevent accidents caused by a human error of not removing the connecting pin after the pressure is loaded between the plates (unloading the pressure between the plates during operation).

Effect of the Invention

The sliding nozzle device according to the present invention is provided with the auxiliary plate-exchanging means interlocking with the sliding means. While the sliding means operates in one direction, the auxiliary plate-exchanging means unloads the pressure on the slide frame, thereby rotating the spring box. While the sliding means operates in the other direction, the auxiliary plate-exchanging means rotates the spring box, thereby pressing the slide frame against the upside frame. Thus, the pressure between the plates can be loaded and unloaded automatically. Furthermore, the auxiliary plate-exchanging means enables a series of automatic operations of loading and unloading pressure between the plates as well as opening and closing the slide frame. As a result, the present invention not only improves workability, but also reduces operators' heavy muscular work under high temperatures.

In the sliding nozzle device according to the present invention, the sliding means operates in the other direction and contacts to the contact portion of the auxiliary plate exchanging means, and the slide axis moves to the other direction, thereby loading the pressure between the plates. Thus, the pressure between the plates is not released if the sliding means operates in one direction thereafter. This can prevents the pressure between the plates from being unloaded accidentally, and further enables the sliding nozzle device to operate at full stroke during control of molten steel flow.

BRIEF DESCRIPTION OF DRAWINGS

FIG. 4 (B) is a plan view of a second engagement groove in one slide axis.

BEST MODE FOR CARRYING OUT THE INVENTION

Embodiments of the present invention will be described referring to the accompanying drawings for a better understanding of the present invention.

Hereinafter, a first engagement member, a first engagement groove, and a first engagement pin respectively indicate an engagement member, an engagement groove, and an engagement pin in a mechanism for opening and closing a slide frame, in which the engagement groove is formed in the engagement member engaging with a slide axis, and the engagement pin is mounted on a proximal end of an arm. A second engagement member, a second engagement groove, and a second engagement pin respectively indicate an engagement member, an engagement groove, and an engagement pin in a mechanism for rotating a spring box, in which the engagement groove is formed in a slide axis, and the engagement pin is mounted on the engagement member engaging with the slide axis. A third engagement member, a third engagement groove, and a third engagement pin respectively indicate an engagement member, an engagement groove, and an engagement pin in a mechanism for rotating a spring box, in which the engagement groove is formed in the engagement member engaging with a slide axis, and the engagement pin is mounted on the slide axis.

First Embodiment

Figure 1:
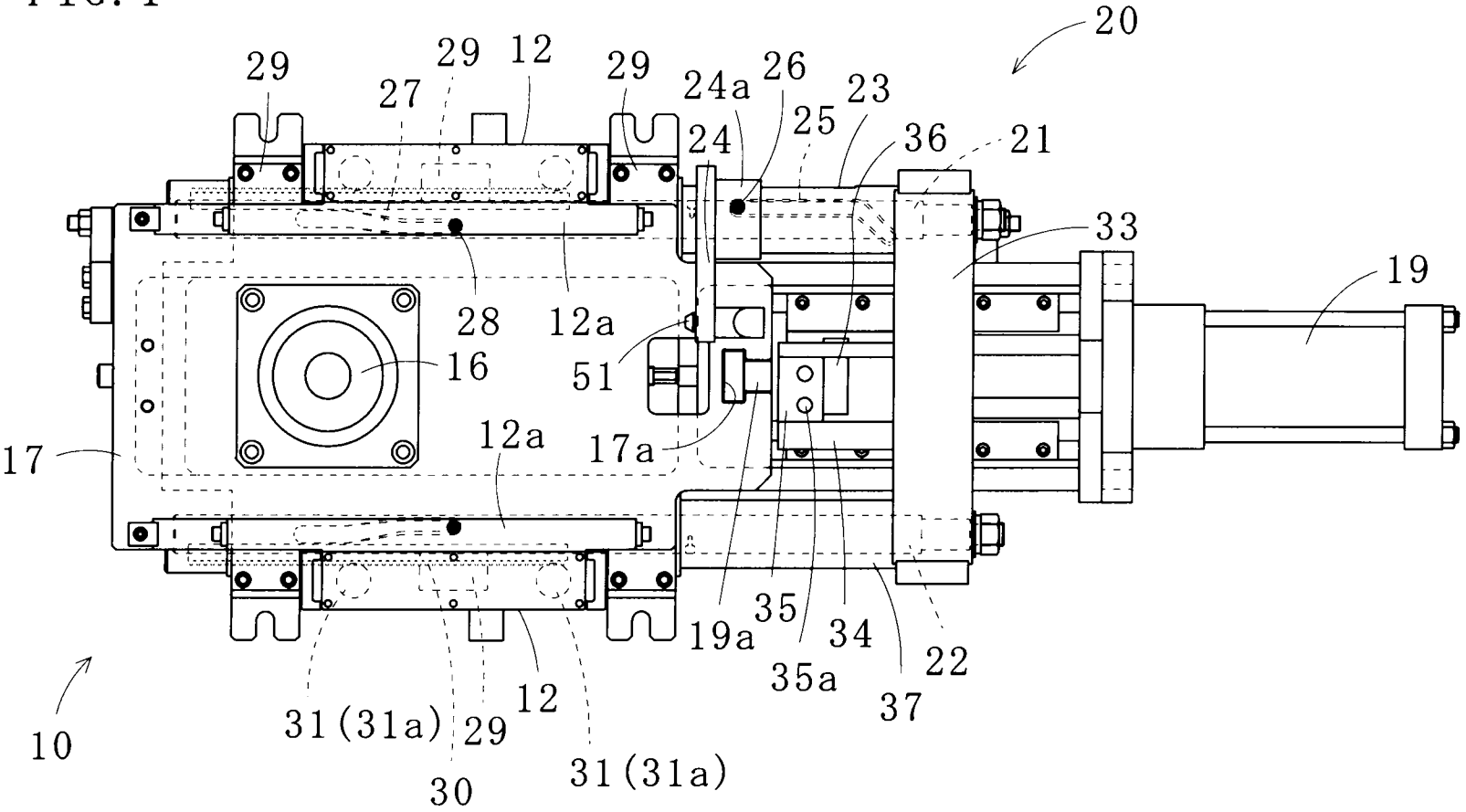
FIG. 1 is a bottom plan view of a sliding nozzle device according to a first embodiment of the present invention.
Figure 2:
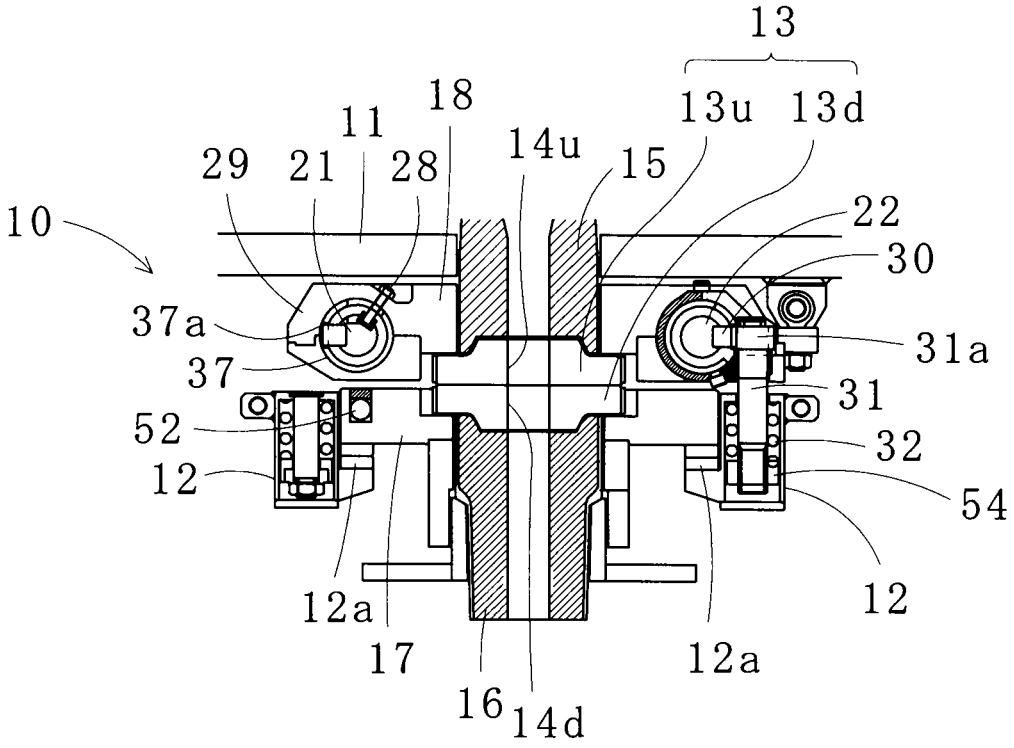
FIG. 2 is a cross-sectional view of the sliding nozzle device viewed from a sliding direction.
Figure 3:
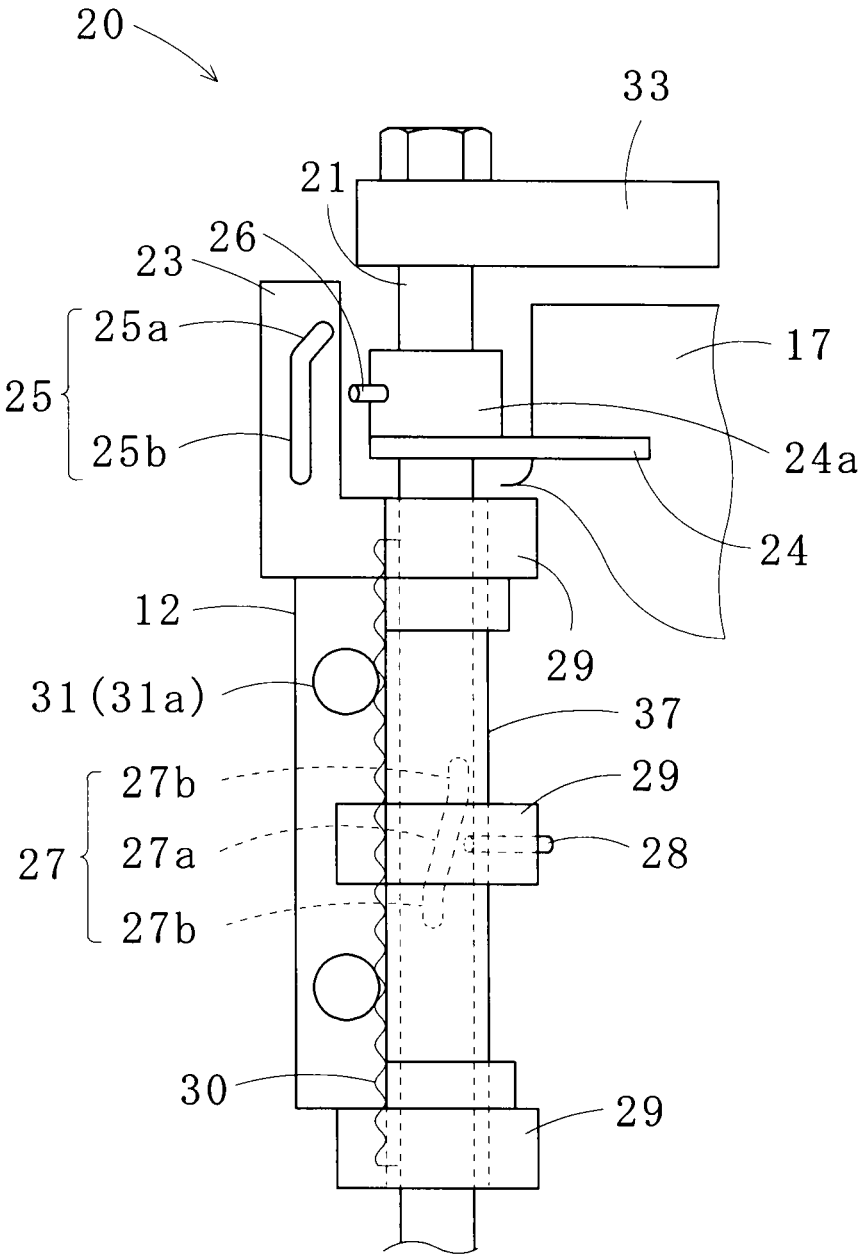
FIG. 3 is an explanatory drawing of a mechanism of an auxiliary plate-exchanging means of the sliding nozzle device.

FIG. 1 is a bottom plan view of a sliding nozzle device 10 according to a first embodiment of the present invention. FIG. 2 is a cross-sectional view of the sliding nozzle device 10 viewed from a sliding direction. FIG. 3 is an explanatory drawing of a mechanism of an auxiliary plate-exchanging means 20. Hereinafter, a "front" refers to a side of a hydraulic cylinder 19*a*, and a "back" refers to the opposite side as a matter of convenience. In addition, a "positive" direction refers to a direction in which a spring box 12 and a slide frame 17 open as well as compression of coil springs 32 releases, and a "negative" direction refers to the opposite direction.

The sliding nozzle device 10 includes an upper plate 13*u* (fixed plate) and a lower plate 13*d* (sliding plate); an upside frame 18 holding the upper plate 13*u*; a slide frame 17 holding the lower plate 13*d*; a hydraulic cylinder 19 (sliding means) for sliding the slide frame 17; spring boxes 12 loading pressure between the upper plate 13*u* and the lower plate 13*d*; and an auxiliary plate-exchanging means 20 interlocking with the hydraulic cylinder 19 and automatically performing a series of operations of loading and unloading pressure between the plates as well as opening and closing the slide frame 17.

The upper plate 13*u* is fixed at a bottom of a molten metal container 11 via the upside frame 18, and an upper nozzle 15 is connected to a nozzle hole 14*u*, i.e., a path of molten steel. On the other hand, the lower plate 13*d* is fixed inside the slide frame 17 which is openable relative to the upside frame 18, and a lower nozzle 16 is connected to a nozzle hole 14*d*, i.e., a path of molten steel. And, the lower plate 13*d* slides along a lower surface of the upper plate 13*u*.

The upside frame 18 extends in a sliding direction of the slide frame 17, and the hydraulic cylinder 19 is placed at one end in the extending direction of the upside frame 18. A distal end of a rod 19*a* of the hydraulic cylinder 19 is fitted in a T-shaped cutout 17*a* formed at one end of the slide frame 17. The T-shaped cutout 17*a* functions as a connecting portion connecting the rod 19*a* of the hydraulic cylinder 19 and the slide frame 17, therefore the slide frame 17 can be opened and closed without interference of the rod 19*a*.

The auxiliary plate-exchanging means 20 includes a pair of slide axes 21, 22 and a horizontal support member 33. The pair of slide axes 21, 22 each have a circular cross-section. The slide axes 21, 22 align in parallel with each other at both sides of the slide frame 17, and extend in the sliding direction of the slide frame 17. The horizontal support member 33 is laid between front portions of the slide axes 21, 22 such that the slide axes 21, 22 are rotatable. Also, the slide axes 21, 22 each are supported by three bearings 29 fixed on the upside frame 18. Thus, the auxiliary plate-exchanging means 20 moves together with the slide frame 17 in the sliding direction of the slide frame 17.

The horizontal support member 33 is provided with a sliding force transmitting portion 34 for transmitting sliding force of the hydraulic cylinder 19 to the auxiliary plate-exchanging means 20. The sliding force transmitting portion 34 has a contact portion 35 to be in contact with a projecting portion 36 provided in the rod 19*a* of the hydraulic cylinder 19. The projecting portion 36 contacts and pushes the contact portion 35, so that the pair of slide axes 21, 22 move in the other direction (a direction in which the nozzle hole 14*u* is closed, in this embodiment).

Figure 5:
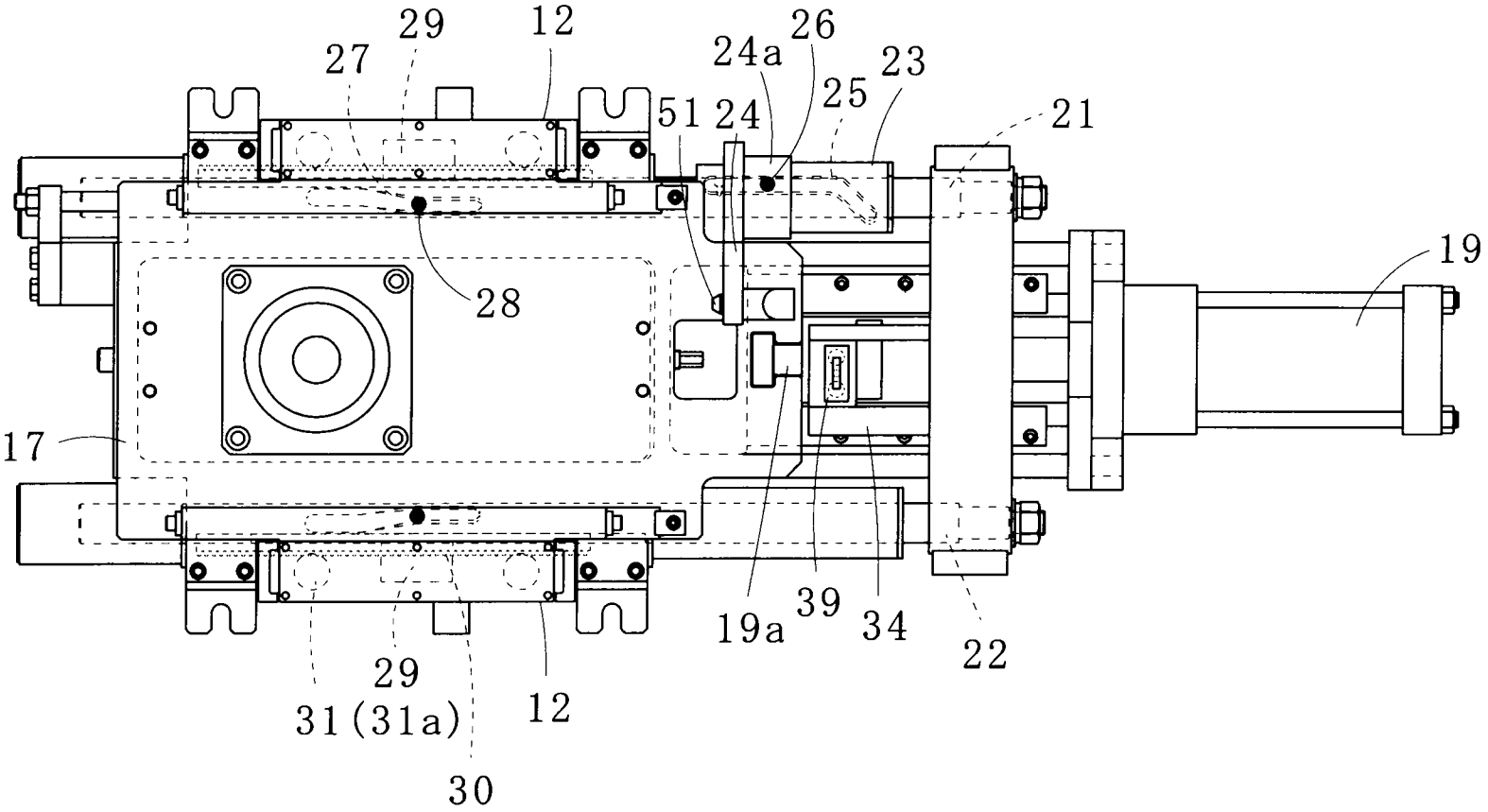
FIG. 5 is a bottom plan view of the sliding nozzle device when spring boxes start to rotate.
Figure 6:
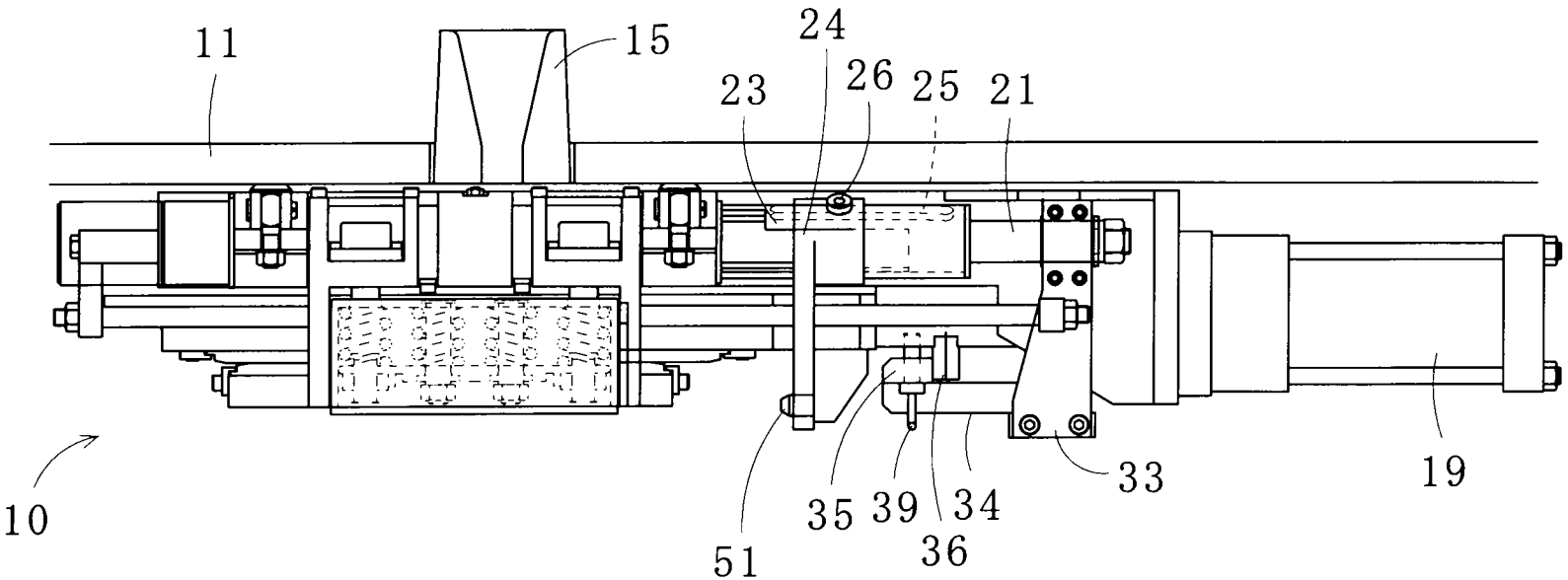
FIG. 6 is a side view of the sliding nozzle device when the spring boxes start to rotate.
Figure 7:
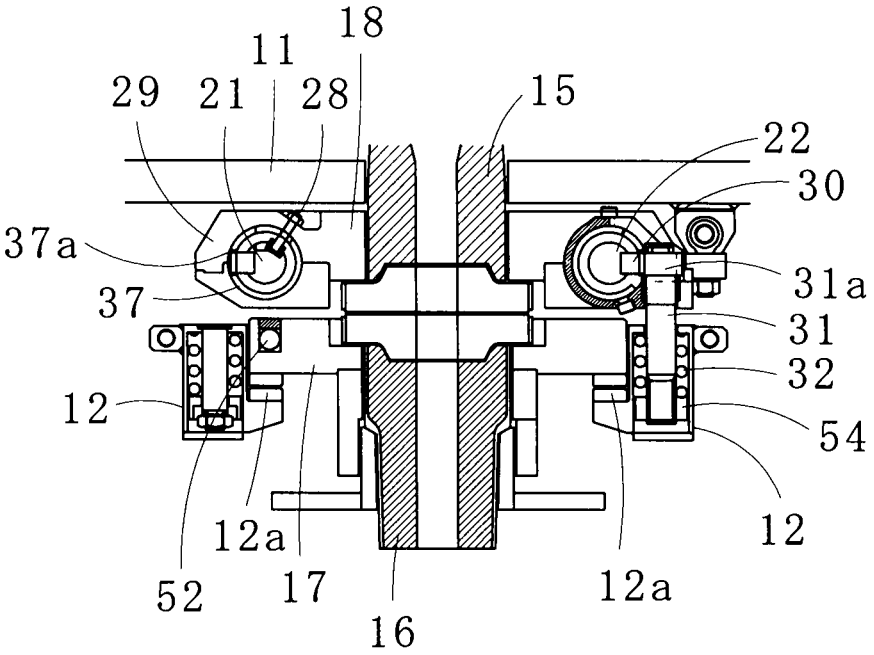
FIG. 7 is a cross-sectional view of the sliding nozzle device viewed from the sliding direction, when the spring boxes start to rotate.
Figure 8:
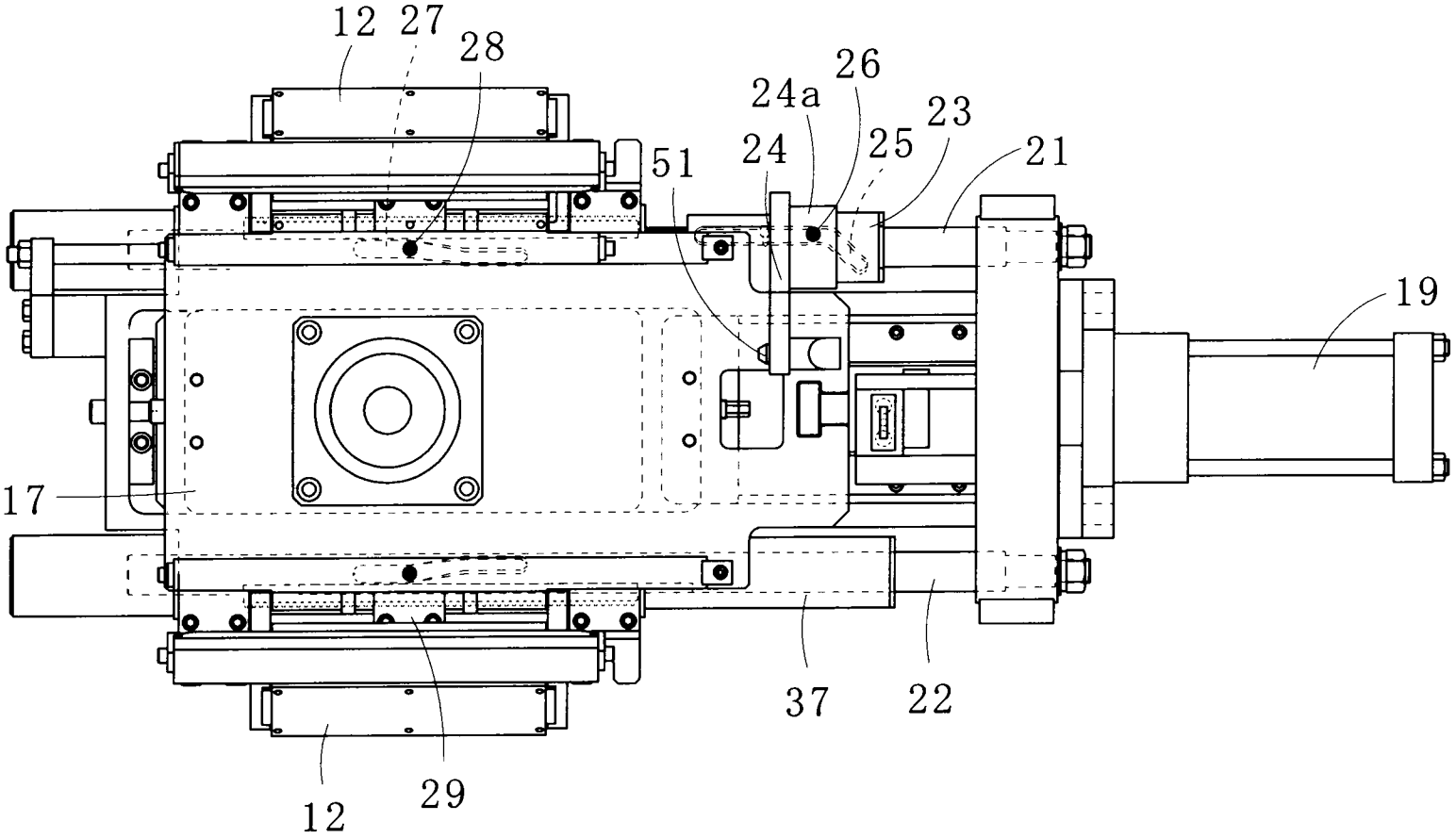
FIG. 8 is a bottom plan view of the sliding nozzle device when the rotation of the spring boxes is completed.
Figure 9:
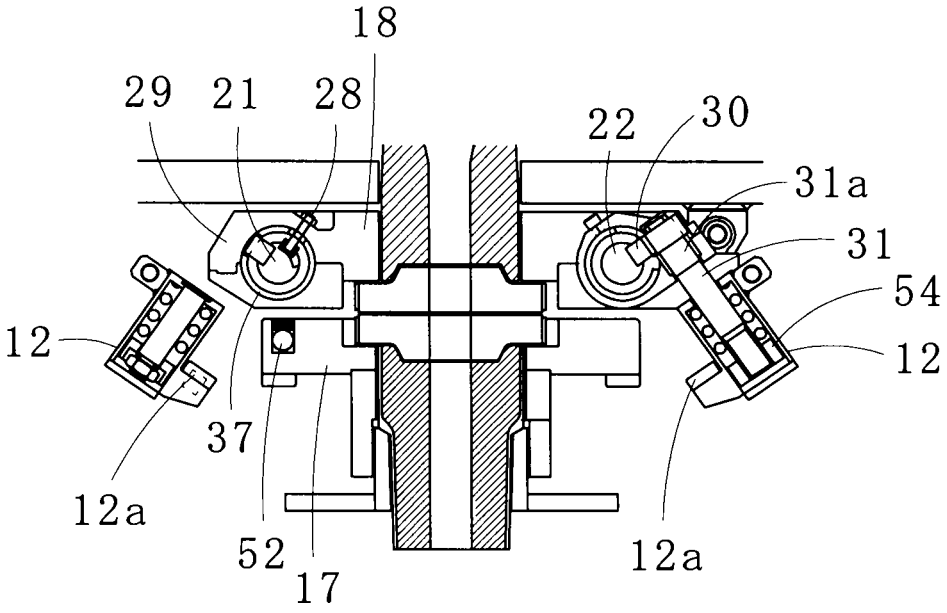
FIG. 9 is a cross-sectional view of the sliding nozzle device viewed from the sliding direction, when the rotation of the spring boxes is completed.

In addition, since a connecting pin 39 (connecting jig) is inserted in a pinhole 35*a* formed in the contact portion 35 (see FIGS. 5 and 6), the rod 19*a* of the hydraulic cylinder 19 and the auxiliary plate-exchanging means 20 are connected to each other, and the auxiliary plate-exchanging means 20 moves in one direction (a direction in which the nozzle hole 14*u* is opened, in this embodiment).

Figure 10:
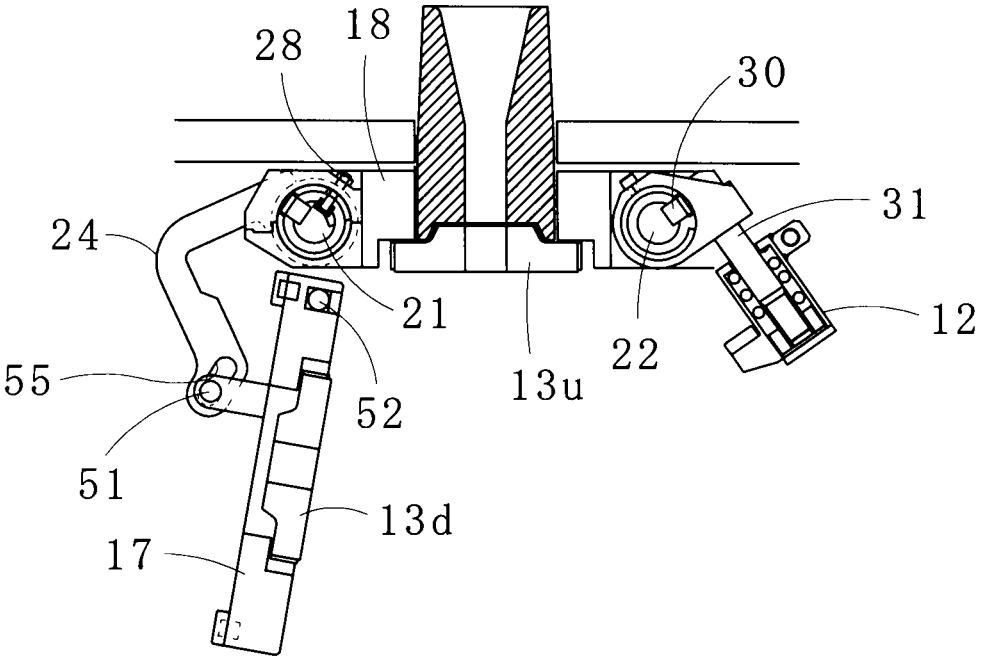
FIG. 10 is a cross-sectional view of the sliding nozzle device viewed from the sliding direction, when an operation for opening the slide frame is completed.

An arm 24 has a distal end connected to the slide frame 17 and a proximal end 24*a* placed around the one slide axis 21. Along with the movement of the slide axis 21, the arm 24 moves in the moving direction of the slide axis 21, and rotates around the slide axis 21, thereby opening and closing the slide frame 17. Here, the slide frame 17 and the arm 24 are connected to each other by a connecting pin 51 mounted on the slide frame 17 in a manner that the connecting pin 51 is inserted from a side of the horizontal support member 33 to a connecting hole 55 formed in the distal end of the arm 24 (see FIG. 10). When the slide frame 17 is slid to control molten steel flow, the connecting pin 51 is removed from the connecting hole 55, in other words, the slide frame 17 and the arm 24 are disconnected. Therefore, the arm 24 and the slide axis 21 are not moved by the sliding movement of the slide frame 17 during flow control. Now, the connecting jig is not limited to the connecting pin 39 having a tip thereof to be inserted in the pinhole 35*a*. It can be an arbitrary jig capable of connecting the slide frame 17 and the arm 24, for example, a jig fitting in a projection (recess) of the slide frame 17 and a recess (projection) of the arm 24, which enables the slide frame 17 and the arm 24 to be connected to each other.

A first engagement pin 26 is mounted on the proximal end 24*a* of the arm 24. The first engagement pin 26 is inserted in a first engagement groove 25 formed in a first engagement member 23. The first engagement member 23 is fixed on the bearing 29 at the front and partly covers the slide axis 21.

Mounted on an intermediate part of each of the slide axes 21, 22 is a rack gear 30, extending in the direction of the slide axes 21, 22. A second engagement groove 27, described hereinbelow, is also formed in the intermediate part of each of the slide axes 21, 22.

Each of the slide axes 21, 22 is inserted in an outer tube 37 having a C-shaped cross-section, and the rack gear 30 is exposed from an opening 37*a* formed on a lateral surface of the outer tube 37. As a result, the rack gears 30 are caught in the openings 37*a* when the slide axes 21, 22 rotate, thereby rotating the outer tubes 37. Each of the slide axes 21, 22 is supported by three bearings 29 via the outer tube 37. The three bearings 29 are fixed on the upside frame 18. The bearings 29 in the middle function as second engagement members engaging with the slide axes 21, 22, and second engagement pins 28 mounted on the bearings 29 are inserted in the second engagement grooves 27 of the slide axis 21, 22, such that the second engagement pins 28 penetrate the outer tubes 37.

Mounted on the outer tubes 37 are spring boxes 12 having band-shaped press portions 12*a* which press the slide frame 17 against the upside frame 18. The outer tubes 37 rotate along with the rotation of the slide axis 21, 22, and thus the spring boxes 12 fixed on the outer tubes 37 rotate in an opening or closing direction thereof. Coil springs 32 (springs) are placed inside the spring boxes 12, and pinion gears 31*a* are mounted on one end of press screws 31. The pinion gears 31*a* mesh with the rack gears 30 mounted on the slide axes 21, 22. The rack and pinion mechanism allows the press screws 31 to rotate and move in an axial direction thereof with the movement of the slide axis 21, 22. Therefore, the coil springs 32 are compressed or the compression of the coil springs 32 is released.

Figure 4A:
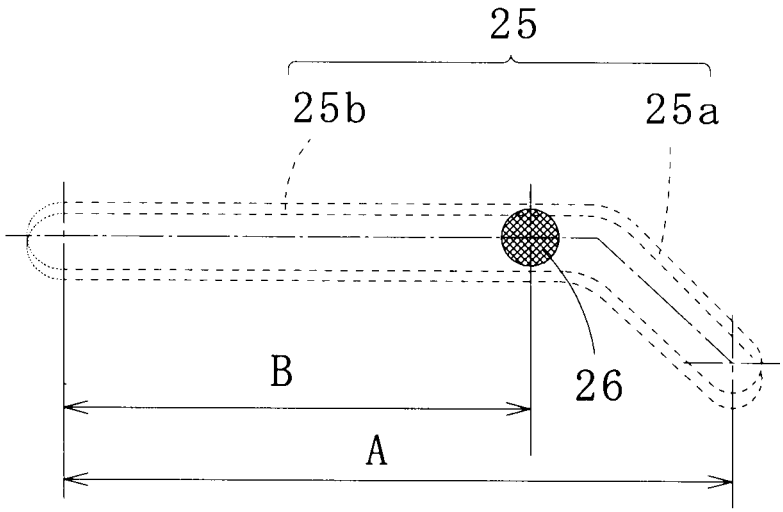
FIG. 4 (A) is a plan view of a first engagement groove in one slide axis.
Figure 4B:
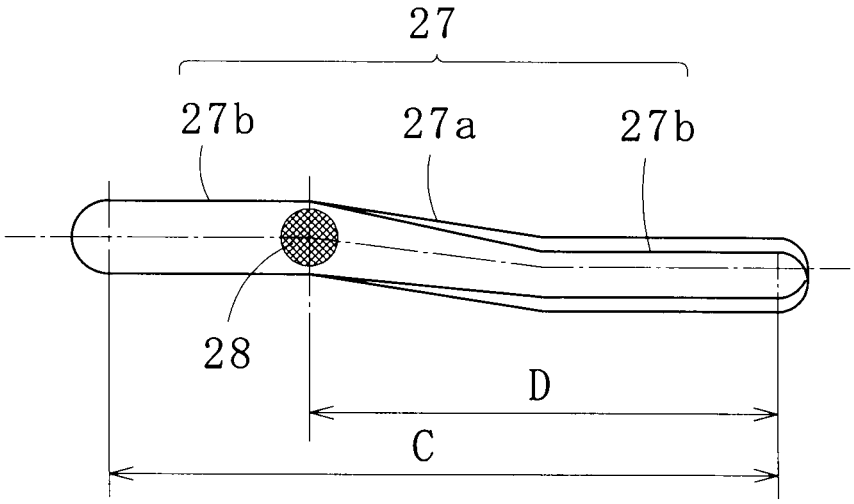

FIGS. 4 (A) and 4 (B) are plan views of a first engagement groove 25 and the second engagement groove 27 in one slide axis 21, respectively. Here, the second engagement groove 27 in the other slide axis 22 is symmetrical to the second engagement groove 27 in one slide axis 21, with respect to the moving direction of the slide axes 21, 22. Alternatively, the first engagement groove 25 can be formed in the other slide axis 22, and in this case, the first engagement groove 25 in the other slide axis 22 is symmetrical to the first engagement groove 25 in the one slide axis 21, with respect to the moving direction of the slide axes 21, 22.

The first engagement groove 25 includes a straight groove 25*b* and a partial spiral groove 25*a*. The straight groove 25*b* extends in the moving direction of the slide axis 21. The partial spiral groove 25*a* is formed in one end of the straight groove 25*b*, and arranged in a spiral around a theoretical axis in parallel with the slide axis 21. On the other hand, the second engagement groove 27 includes straight grooves 27*b* at both ends thereof and a partial spiral groove 27*a* in an intermediate part thereof. The straight grooves 27*b* extend in the moving direction of the slide axes 21, 22. The partial spiral groove 27*a* is arranged in a spiral around a theoretical axis in parallel with the slide axes 21, 22. An entire length A of the first engagement groove 25 and an entire length C of the second engagement groove 27 are the same. Also, a length B of the straight groove 25*b* in the first engagement groove 25 has the same length as a length D from a start point of the one straight groove 27*b* to an end point of the partial spiral groove 27*a* in the second engagement groove 27.

In the sliding nozzle device 10 having the above-described configuration according to this embodiment, when the hydraulic cylinder 19 shrinks and the slide axes 21, 22 move to the front with the connecting pin 39 inserted in the pinhole 35*a* of the sliding force transmitting portion 34, firstly, the rack gears 30 mounted on the slide axes 21, 22 rotate the press screws 31 in the spring boxes 12, therefore the spring boxes 12 unload the pressure between the plates. Secondly, the slide axes 21, 22 rotate in the positive direction, thereby opening the spring boxes 12. Thirdly, the arm 24 rotates in the positive direction, thereby opening the slide frame 17. In this way, the plate 13 will be exchangeable.

On the other hand, when the hydraulic cylinder 19 extends and the projecting portion 36 pushes the contact portion 35 of the sliding force transmitting portion 34, firstly, the arm 24 rotates in the negative direction, thereby closing the slide frame 17. Secondly, the slide axes 21, 22 rotate in the negative direction, thereby closing the spring boxes 12. Thirdly, the rack gears 30 mounted on the slide axes 21, 22 rotate the press screws 31 of the spring boxes 12, therefore the spring boxes 12 load the pressure between the plates.

For opening and closing the slide frame 17, the first engagement member 23, the first engagement groove 25, and the first engagement pin 26 may be omitted, and in this case, the slide frame 17 will be manually opened and closed.

Hereinafter, referring to FIGS. 5 to 10, a detail description will be given on operations of the auxiliary plate-exchanging means 20 of the sliding nozzle device 10.

Now, a description will be given on operations of unloading pressure on the slide frame 17, rotating the spring box 12, and opening the slide frame 17.

(1) The rod 19*a* of the hydraulic cylinder 19 is extended and shrunk, so that the pinhole 35*a* formed in the contact portion 35 of the sliding force transmitting portion 34 and a pinhole (not illustrated) formed in the rod 19*a* are aligned. Subsequently, the connecting pin 39 is inserted in the pinhole 35*a*, thereby connecting the rod 19*a* of the hydraulic cylinder 19 and the auxiliary plate-exchanging means 20 (see FIGS. 5 and 6).

(2) The rod 19*a* of the hydraulic cylinder 19 is shrunk, so that the slide axes 21, 22 move to the front (in a direction in which the nozzle hole 14*u* is opened). Accompanied by this movement, the rack gear 30 moves, and the pinion gear 31*a* meshing with the rack gear 30 and the press screw 31 integrated with the pinion gear 31*a* rotate in the positive direction. Then, compression of the coil spring 32 is released for loosening a compression board 54 having a female screw (see FIGS. 5 to 7). Meanwhile, the first engagement pin 26 moves in the straight groove 25*b* of the first engagement groove 25, and the second engagement pins 28 move in the straight grooves 27*b* of the second engagement grooves 27, therefore the slide axes 21, 22 and the arm 24 do not rotate.

(3) The slide axes 21, 22 continuously move to the front, and positions of the second engagement pins 28 are regulated by the partial spiral grooves 27*a* of the second engagement grooves 27. According to this regulation, the slide axes 21, 22 rotate in the positive direction. Each of the slide axes 21, 22 is inserted in the outer tube 37 having a C-shaped cross-section, and the rack gear 30 is exposed from the opening 37*a* formed on the lateral surface of the outer tube 37. As a result, the rack gears 30 are caught in the openings 37*a* when the slide axes 21, 22 rotate, and the outer tubes 37 rotate along with the rotation of the slide axes 21, 22. In this way, the spring box 12 mounted on the outer tube 37 rotates in the positive direction, thereby separating the press portion 12*a* from the slide frame 17 (see FIGS. 8 and 9). Meanwhile, the first engagement pin 26 moves in the straight groove 25*b* of the first engagement groove 25, therefore the arm 24 does not rotate.

(4) When the slide axes 21, 22 further move to the front, the arm 24 moves to the front while a position of the first engagement pin 26 is regulated by the partial spiral groove 25*a* of the first engagement groove 25. And thus, the arm 24 rotates in the positive direction around the slide axis 21. The connecting pin 51 mounted on the slide frame 17 is inserted in the connecting hole 55 formed in the distal end of the arm 24, and the slide frame 17 rotates in the positive direction around the slide frame axis 52 (see FIG. 10) along with the rotation of the arm 24. Meanwhile, the second engagement pins 28 move in the straight grooves 27*b* of the second engagement grooves 27, therefore the slide axes 21, 22 do not rotate.

In contrast, the rod 19*a* of the hydraulic cylinder 19 needs to be extended for closing the slide frame 17, rotating the spring box 12 in the negative direction, and pressing the slide frame 17 against the upside frame 18. At this time, it is not necessary to insert the connecting pin 39 in the pinhole 35*a*. The projecting portion 36 provided in the rod 19*a* contacts and pushes the contact portion 35 of the sliding force transmitting portion 34, so that the slide axes 21, 22 move to the back (in a direction in which the nozzle hole 14*u* is closed). Then, the following operations are continuously performed.

(1) The rod 19*a* of the hydraulic cylinder 19 is extended, and the slide axes 21, 22 move to the back (in a direction in which the nozzle hole 14*u* is closed). Then, a position of the first engagement pin 26 is regulated by the partial spiral groove 25*a* of the first engagement groove 25, thereby moving the arm 24 in the backward direction. According to this regulation, the arm 24 rotates in the negative direction around the slide axis 21, and the slide frame 17, supported by the distal end of the arm 24, rotates in the negative direction around the slide frame axis 52 and becomes closed. Meanwhile, the second engagement pins 28 move in the straight grooves 27*b* of the second engagement grooves 27, therefore the slide axes 21, 22 do not rotate.

(2) The slide axes 21, 22 continuously move to the back, and positions of the second engagement pins 28 are regulated by the partial spiral grooves 27*a* of the second engagement grooves 27. According to this regulation, the slide axes 21, 22 rotate in the negative direction. Then, the outer tubes 37 rotate, in which the slide axes 21, 22 are inserted, and the press portions 12*a* of the spring boxes 12 mounted on the outer tubes 37 move closer to the slide frame 17. Meanwhile, the first engagement pin 26 moves in the straight groove 25*b* of the first engagement groove 25, therefore the arm 24 does not rotate.

(3) The slide axes 21, 22 further move to the back. Accompanied by the movement of the rack gear 30, the pinion gear 31*a* meshing with the rack gear 30 and the press screw 31 integrated with the pinion gear 31*a* rotate in negative direction. Then, the compression board 54 having a female screw is pulled, and the coil spring 32 is compressed. Meanwhile, the first engagement pin 26 moves in the straight groove 25*b* of the first engagement groove 25, and the second engagement pins 28 move in the straight grooves 27*b* of the second engagement grooves 27, therefore the slide axes 21, 22 and the arm 24 do not rotate.

Since the connecting pin 39 is removed, the slide axes 21, 22 do not move and the pressure between the plates is not released even if the rod 19*a* of the hydraulic cylinder 19 is shrunk thereafter.

Second Embodiment

Figure 11:
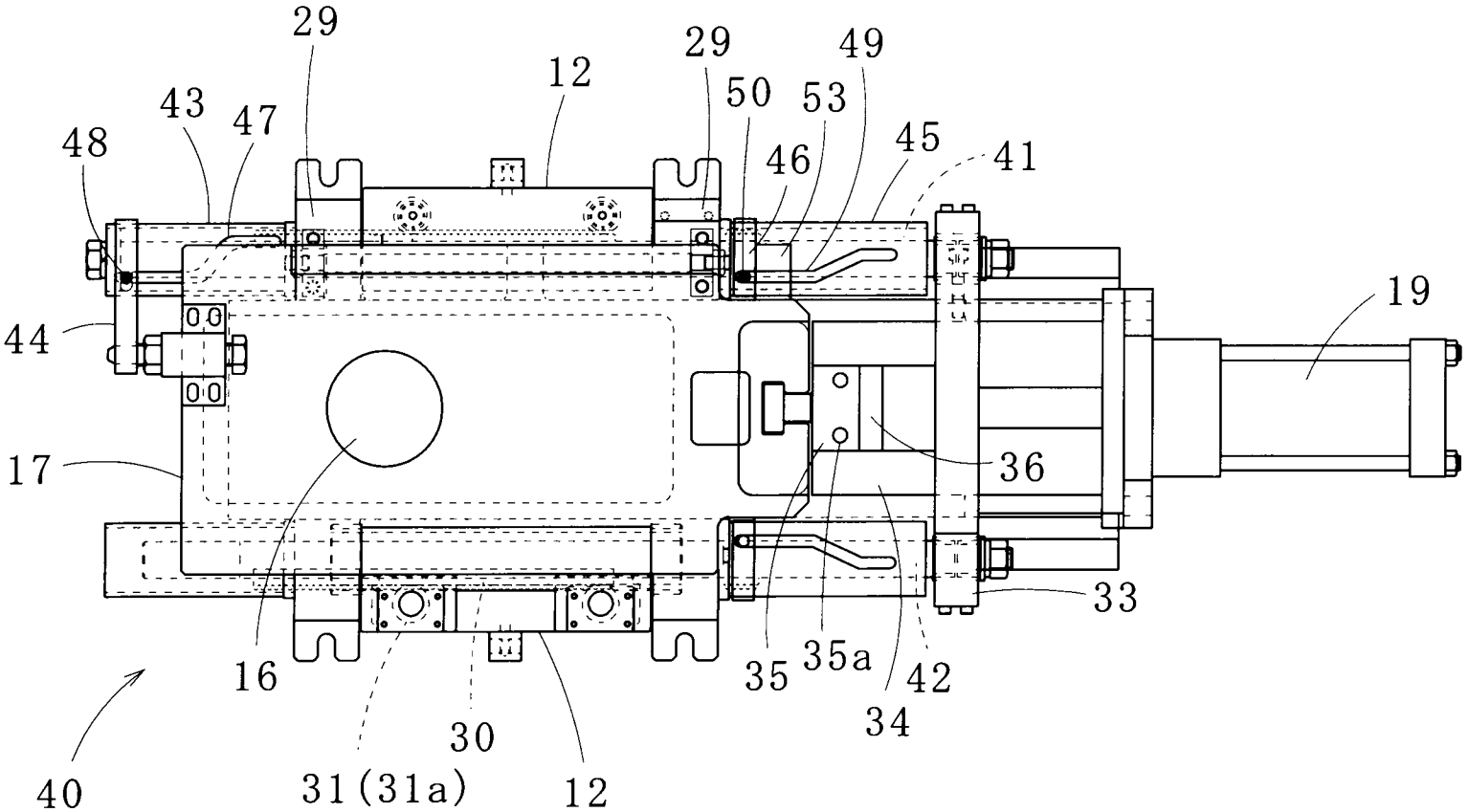
FIG. 11 is a bottom plan view of a sliding nozzle device according to a second embodiment of the present invention.
Figure 12:
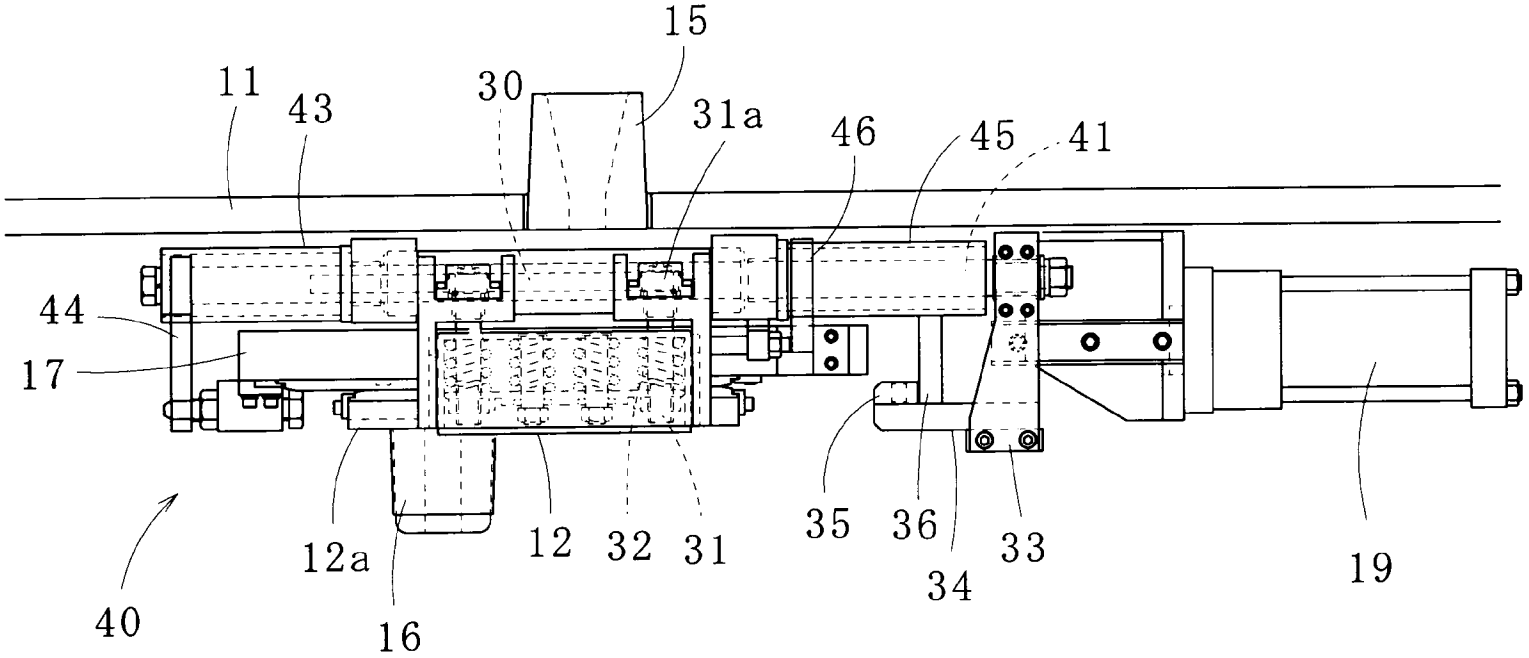
FIG. 12 is a side view of the sliding nozzle device.

FIGS. 11 and 12 are a bottom plan view and a side view of a sliding nozzle device 40 according to a second embodiment of the present invention, respectively. Hereinafter, the same components as the first embodiment are given the same numerals, and explanations therefor are omitted.

In this embodiment, a slide frame 17 is rotatably supported by two arms 44, 46. The arm 44 has a proximal end placed around a back portion of one slide axis 41, and a distal end connected to the slide frame 17. The arm 44 rotates around the slide axis 41. Also, the arm 46 is placed around the slide axis 41. When the sliding nozzle device 40 is set upright for exchanging plates, the arm 46 comes in contact with an extending portion 53 extending from the slide frame 17, and supports the slide frame 17. The extending portion 53 and the slide frame 17 are in contact with each other at smooth surfaces thereof, thereby not interrupting the operation for opening and closing the slide frame 17. In addition, a cylindrical-shaped third engagement member 45 covering the slide axis 41 is fixed on a bearing 29 at the front. The arm 46 has a proximal end placed around the third engagement member 45, and a distal end connected to the slide frame 17. The arm 46 is circumferentially rotatable on the third engagement member 45, and also movable in the moving direction of the slide axis 41. Now, the third engagement member 45 is also placed in the slide axis 42, but the arm is not mounted thereon.

A first engagement member 43 partially covering the slide axis 41 is fixed on a bearing 29 at the back, and a first engagement groove 47 is formed in the first engagement member 43. The first engagement groove 47 includes a partial spiral groove, arranged in a spiral around a theoretical axis in parallel with the slide axis 41. A first engagement pin 48 is mounted on the proximal end of the arm 44, and inserted in the first engagement groove 47 formed in the first engagement member 43.

Third engagement grooves 49 are provided in the third engagement members 45 formed in the bearings 29 at the front. The third engagement grooves 49 include partial spiral grooves, arranged in a spiral around a theoretical axis in parallel with the slide axes 41, 42. And, third engagement pins 50 mounted on the slide axes 41, 42 are inserted in the third engagement grooves 49.

Here, the third engagement groove 49 is symmetrical to the second engagement groove 27 in the first embodiment with respect to the moving direction of the slide axes.

In this embodiment, the first engagement pin 48 mounted on the proximal end of the arm 44 moves along the partial engagement groove of the first engagement groove 47 formed in the first engagement member 43, thereby rotating the arm 44 around the slide axis 41, and then opening and closing the slide frame 17. In addition, the third engagement pins 50 mounted on the slide axes 41, 42 move along the partial engagement grooves of the third engagement grooves 49 formed in the third engagement members 45, thereby rotating the slide axes 41, 42 and the spring boxes 12.

As well as the first embodiment, for opening and closing the slide frame 17, the first engagement member 43, the first engagement groove 47, and the first engagement pin 48 may be omitted, and in this case, the slide frame 17 is manually opened and closed.

Third Embodiment

Figure 13:
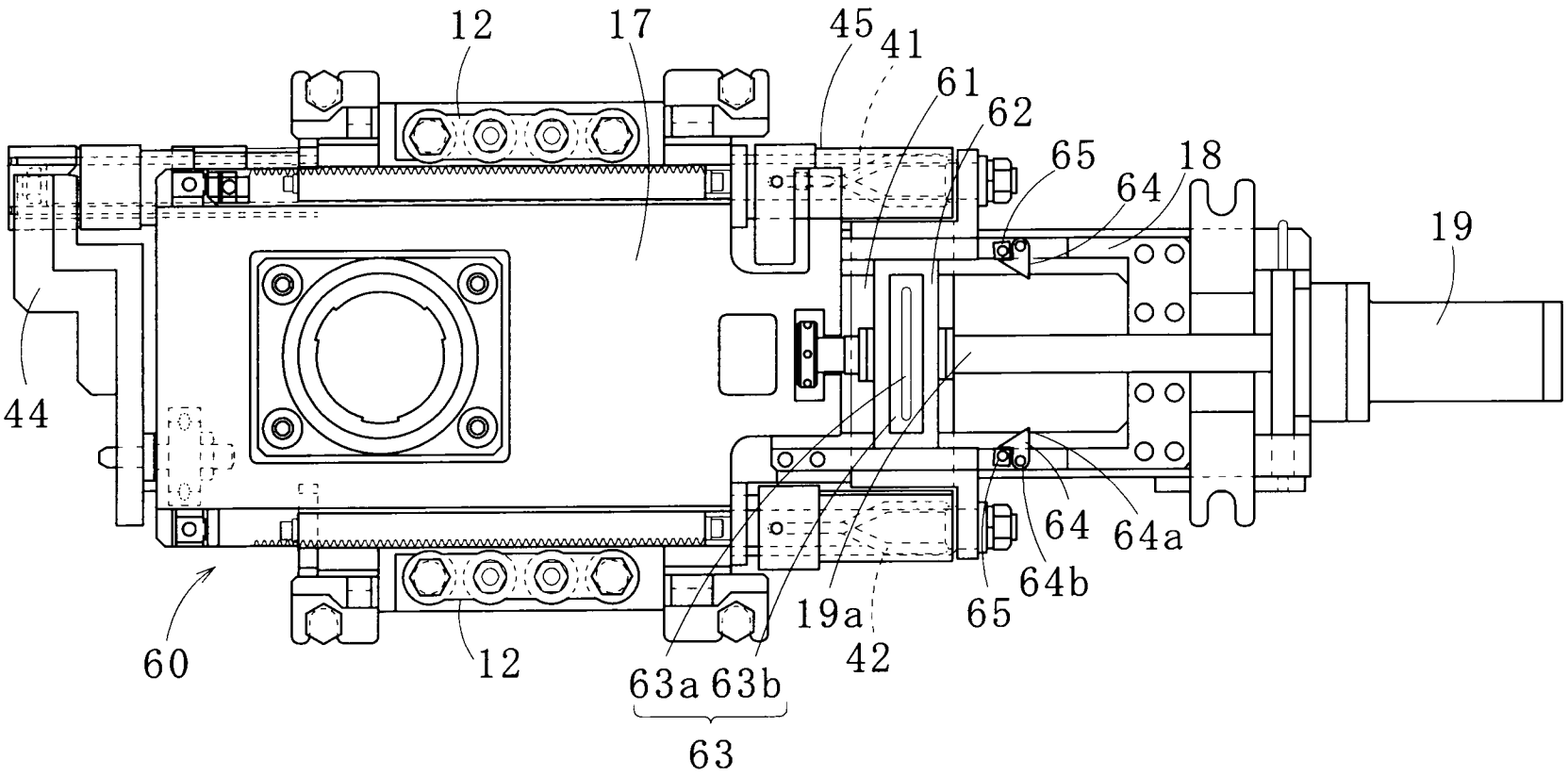
FIG. 13 is a bottom plan view of a sliding nozzle device according to a third embodiment of the present invention.
Figure 14:
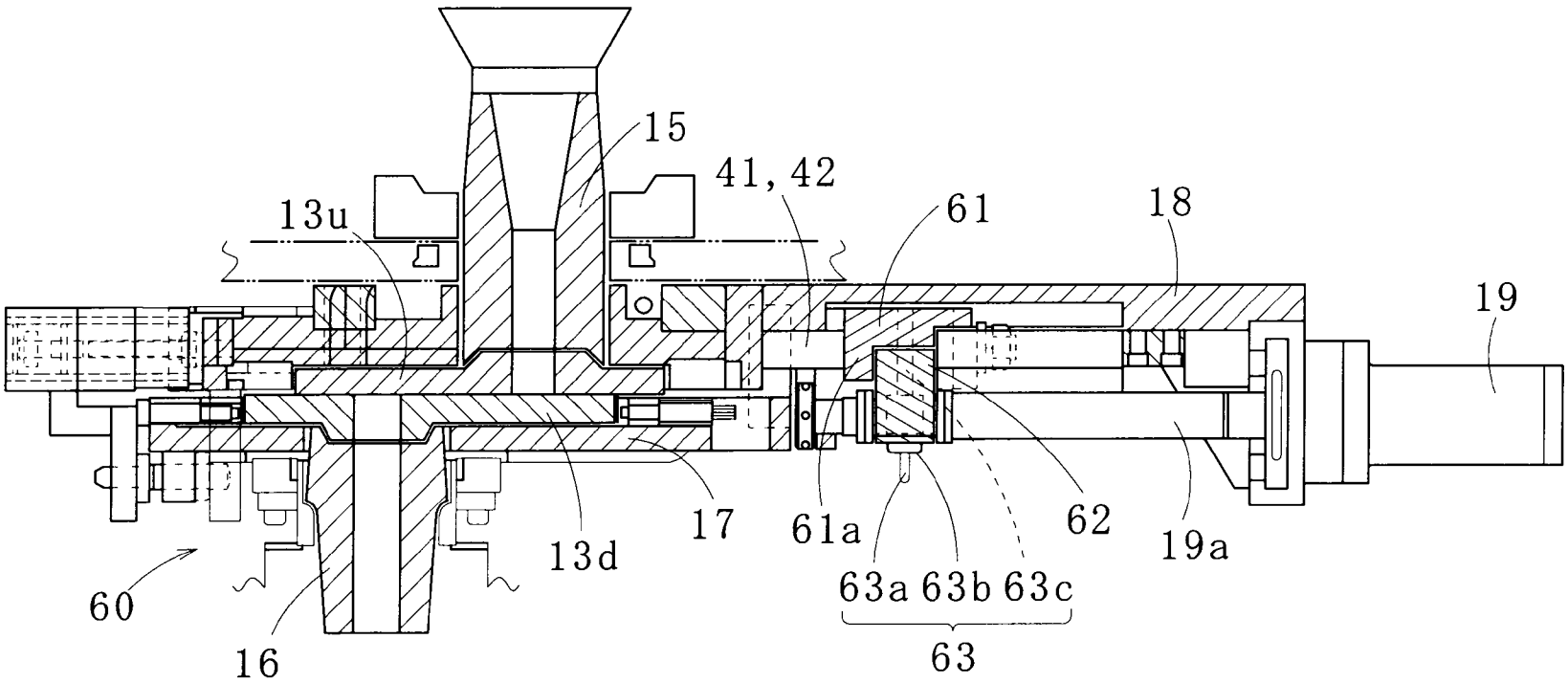
FIG. 14 is a sectional side view of the sliding nozzle device.

FIGS. 13 and 14 are a bottom plan view and a side view of a sliding nozzle device 60 according to a third embodiment of the present invention, respectively. Hereinafter, the same components as the first and second embodiments are given the same numerals, and explanations therefor are omitted.

In this embodiment, a horizontal support member 61 arranged between slide axes 41, 42 is placed between a rod 19*a* of a hydraulic cylinder 19 and an upside frame 18. A contact portion 61*a* is provided at a back of the horizontal support member 61, and the contact portion 61*a* comes in contact with a projecting portion 62 of the rod 19*a*. A pair of pinholes (not illustrated) is formed at a bottom of the projecting portion 62 attached to an intermediate part of the rod 19*a*. And, a connecting pin 63 (connecting jig), connecting the horizontal support member 61 and the projecting portion 62, is inserted in the pinholes.

The connecting pin 63 includes a handle 63*a* and a prismatic body 63*b*. The handle 63*a* is formed at one side of the prismatic body 63*b*, and a pin 63*c* to be inserted in the pair of the pinholes is formed at the other side thereof.

A pair of the safety levers 64 is provided at both front sides of the upside frame 18, each having a proximal end 64*b* and a distal end 64*a*. The proximal end 64*b* is rotatably supported by the upside frame 18, and the distal end 64*a* comes in contact with the body 63*b* of the connecting pin 63, thereby rotating the safety lever 64. Each of the safety levers 64 has a stopper 65 proximally placed at the back thereof. If the distal end 64*a* of the safety lever 64 moves backward, the distal end 64*a* comes in contact with the stopper 65. Thus, the distal ends 64*a* of the pair of the safety levers 64 cannot rotate backward, and can rotate forward only.

If the slide axes 41, 42 move to the back and the pressure is loaded between the plates when the connecting pin 63 is mounted on the projecting portion 62, the body 63*b* of the connecting pin 63 comes in contact with the pair of the safety levers 64 and prevents the slide axes 41, 42 from moving to the back. For this reason, the connecting pin 63 has to be removed before the pressure is loaded between the plates. Accordingly, accidents caused by a human error of not removing the connecting pin 63 after the pressure is loaded between the plates (unloading the pressure between the plates during operation) can be prevented.

In addition, a bottom peripheral portion of the projecting portion 62 is located closer to the upside frame than the safety levers 64. Therefore, the projecting portion 62 does not come in contact with the safety levers 64 when the slide axes 41, 42 move.

While the embodiments of the present invention have been described above, the present invention is not limited to the above-described embodiments, and other embodiments and various modifications may be made without departing from the scope or spirit of the present invention.

For example, in the above-described embodiments, the first engagement groove is formed in the first engagement member for opening and closing the slide frame, and the second engagement groove is formed in the slide axis for rotating the spring box. However, the first engagement groove may be formed in the first engagement member for rotating the spring box, and the second engagement groove may be formed in the slide axis for opening and closing the slide frame. Likewise, in the above-described embodiments, the third engagement groove is formed in the third engagement member for rotating the spring box, however, the third engagement groove may be formed in the third engagement member for opening and closing the slide frame. Also, in the above-described embodiments, the hydraulic cylinder is a direct acting type, but may be link type via an arm. In addition, it has to be noted that the position of the partial spiral groove in the engagement groove changes according to an object to be rotated.

INDUSTRIAL APPLICABILITY

The present invention is applicable to a sliding nozzle device for controlling molten steel flow discharged from a ladle to a tundish. The present invention can automatically perform a series of operations of loading and unloading pressure between plates as well as opening and closing a slide frame.

DESCRIPTION OF REFERENCE NUMERALS

10: sliding nozzle device; 11: molten metal container; 12: spring box; 12*a*: press portion; 13: plate; 13*u*: upper plate (fixed plate); 13*d*: lower plate (sliding plate); 14*u*, 14*d*: nozzle bore; 15: upper nozzle; 16: lower nozzle; 17: slide frame; 17*a*: cutout; 18: upside frame; 19: hydraulic cylinder (sliding means); 19*a*: rod; 20: auxiliary plate-exchanging means; 21, 22: slide axis; 23: first engagement member; 24: arm; 24*a*: proximal end; 25: first engagement groove; 25*a*: partial spiral groove; 25*b*: straight groove; 26: first engagement pin; 27: second engagement groove; 27*a*: partial spiral groove; 27*b*: straight groove; 28: second engagement pin; 29: bearing (second engagement member); 30: rack gear; 31: press screw; 31*a*: pinion gear; 32: coil spring (spring); 33: horizontal support member; 34: sliding force transmitting portion; 35: contact portion; 36: projecting portion; 37: outer tube; 37*a*: opening; 39: connecting pin (connecting jig); 40: sliding nozzle device; 41, 42: slide axis; 43: first engagement member; 44: arm; 45: third engagement member; 46: arm; 47: first engagement groove; 48: first engagement pin; 49: third engagement groove; 50: third engagement pin; 51: connecting pin; 52: slide frame axis; 53: extending portion; 54: compression board; 55: connection hole; 60: sliding nozzle device; 61: horizontal support member; 61*a*: contact portion; 62: projecting portion; 63: connecting pin (connecting jig); 63*a*: handle; 63*b*: body; 63*c*: pin; 64: safety lever; 64*a*: distal end; 64*b*: proximal end; 65: stopper

The invention claimed is:

1. A sliding nozzle device including:

an upside frame holding a fixed plate, the upside frame placed at a bottom of a molten metal container;

a slide frame holding a sliding plate, the slide frame being openable relative to the upside frame;

a sliding means for sliding the slide frame; and a spring box pressing the slide frame against the upside frame, the spring box rotatably fixed to the upside frame; the device comprising:

an auxiliary plate-exchanging means interlocking with the sliding means, wherein the auxiliary plate-exchanging means is configured to unload the pressure on the slide frame by rotating the spring box while the sliding means operates in a first direction, wherein the auxiliary plate-exchanging means is configured to press the slide frame against the upside frame by rotating the spring box while the sliding means operates in a second direction opposite the first direction, wherein the auxiliary plate-exchanging means includes:

a slide axle moving in the same direction as the sliding means;

an engagement member engaging with the slide axle, the engagement member fixed on the upside frame; and an arm having a proximal end placed around the slide axle and a distal end connected to the spring box; wherein an engagement pin mounted on the proximal end of the arm is inserted into an engagement groove formed in the engagement member; and as the engagement pin moves in the engagement groove according to movement of the slide axle, the arm rotates around the slide axle, and the spring box connected with the arm rotates in an opening or closing direction of the spring box.

2. The sliding nozzle device of claim 1, wherein the auxiliary plate-exchanging means includes:

a slide axle moving in the same direction as the sliding means;

an engagement member engaging with the slide axle, the engagement member fixed on the upside frame; and an outer tube having the spring box fixed thereon, the outer tube placed around the slide axle, the outer tube rotating according to rotation of the slide axle; and wherein an engagement pin mounted on the engagement member is inserted into an engagement groove formed in the slide axle;

according to movement of the slide axle, the engagement pin moves in the engagement groove, and the slide axle rotates; and according to the rotation of the slide axle, the outer tube rotates, and the spring box rotates in an opening or closing direction of the spring box.

3. The sliding nozzle device of claim 1, wherein the auxiliary plate-exchanging means includes:

a slide axle moving in the same direction as the sliding means;

an engagement member engaging with the slide axle, the engagement member fixed on the upside frame; and an outer tube having the spring box fixed thereon, the outer tube placed around the slide axle, the outer tube rotating according to rotation of the slide axle; and wherein an engagement pin mounted on the slide axle is inserted into an engagement groove formed in the engagement member;

according to movement of the slide axle, the engagement pin moves in the engagement groove and the slide axle rotates; and according to the rotation of the slide axle, the outer tube rotates, and the spring box rotates in an opening or closing direction of the spring box.

4. The sliding nozzle device of claim 1, wherein a rack gear is mounted on and along the slide axle;

a pinion gear is mounted on a press screw, the pinion gear engaging with the rack gear, the press screw compressing a spring placed inside the spring box or releasing the compression of the spring; and according to the movement of the slide axle, the press screw rotates to compress the spring or to release the compression of the spring.

5. The sliding nozzle device of claim 1, wherein the auxiliary plate-exchanging means has a contact portion to be contacted by the sliding means;

the sliding means operates in the second direction and contacts with the contact portion, and the slide axle moves in the second direction; and the auxiliary plate-exchanging means is connected to the sliding means by a connecting jig, thereby the sliding means operates in the first direction, and the slide axle moves in the first direction.

6. The sliding nozzle device of claim 2, wherein a rack gear is mounted on and along the slide axle;

a pinion gear is mounted on a press screw, the pinion gear engaging with the rack gear, the press screw compressing a spring placed inside the spring box or releasing the compression of the spring; and according to the movement of the slide axle, the press screw rotates to compress the spring or to release the compression of the spring.

7. The sliding nozzle device of claim 3, wherein a rack gear is mounted on and along the slide axle;

a pinion gear is mounted on a press screw, the pinion gear engaging with the rack gear, the press screw compressing a spring placed inside the spring box or releasing the compression of the spring; and according to the movement of the slide axle, the press screw rotates to compress the spring or to release the compression of the spring.

8. The sliding nozzle device of claim 2, wherein the auxiliary plate-exchanging means has a contact portion to be contacted by the sliding means;

the sliding means operates in the second direction and contacts with the contact portion, and the slide axle moves in the second direction; and the auxiliary plate-exchanging means is connected to the sliding means by a connecting jig, thereby the sliding means operates in the first direction, and the slide axle moves in the first direction.

9. The sliding nozzle device of claim 3, wherein the auxiliary plate-exchanging means has a contact portion to be contacted by the sliding means;

the sliding means operates in the second direction and contacts with the contact portion, and the slide axle moves in the second direction; and the auxiliary plate-exchanging means is connected to the sliding means by a connecting jig, thereby the sliding means operates in the first direction, and the slide axle moves in the first direction.

10. A sliding nozzle device including:

an upside frame holding a fixed plate, the upside frame placed at a bottom of a molten metal container;

a slide frame holding a sliding plate, the slide frame being openable relative to the upside frame;

a sliding means for sliding the slide frame; and a spring box pressing the slide frame against the upside frame, the spring box rotatably fixed to the upside frame; the device comprising:

an auxiliary plate-exchanging means interlocking with the sliding means, wherein the auxiliary plate-exchanging means is configured to unload the pressure on the slide frame by rotating the spring box and opening the slide frame while the sliding means operates in a first direction, wherein the auxiliary plate-exchanging means is configured to close the slide frame, rotate the spring box, and press the slide frame against the upside frame while the sliding means operates in a second direction opposite the first direction, wherein the auxiliary plate-exchanging means includes:

a slide axle moving in the same direction as the sliding means;

an engagement member engaging with the slide axle, the engagement member fixed on the upside frame; and an arm having a proximal end placed around the slide axle and a distal end connected to the slide frame or the spring box; and wherein an engagement pin mounted on the proximal end of the arm is inserted into an engagement groove formed in the engagement member;

as the engagement pin moves in the engagement groove according to movement of the slide axle, the arm rotates around the slide axle; and the slide frame or the spring box connected with the arm rotates in an opening or closing direction of the slide frame or the spring box.

11. The sliding nozzle device of claim 10, wherein the auxiliary plate-exchanging means includes:

a slide axle moving in the same direction as the sliding means;

an engagement member engaging with the slide axle, the engagement member fixed on the upside frame; and an outer tube having the spring box or the slide frame fixed thereon, the outer tube placed around the slide axle, the outer tube rotating according to rotation of the slide axle; and wherein an engagement pin mounted on the engagement member is inserted into an engagement groove formed in the slide axle;

according to movement of the slide axle, the engagement pin moves in the engagement groove, and the slide axle rotates; and according to the rotation of the slide axle, the outer tube rotates, and the spring box or the slide frame rotates in an opening or closing direction of the spring box or the slide frame.

12. The sliding nozzle device of claim 10, wherein the auxiliary plate-exchanging means includes:

a slide axle moving in the same direction as the sliding means;

an engagement member engaging with the slide axle, the engagement member fixed on the upside frame; and an outer tube having the spring box or the slide frame fixed thereon, the outer tube placed around the slide axle, the outer tube rotating according to rotation of the slide axle; wherein an engagement pin mounted on the slide axle is inserted into an engagement groove formed in the engagement member;

according to movement of the slide axle, the engagement pin moves in the engagement groove, and the slide axle rotates; and according to the rotation of the slide axle, the outer tube rotates, and the spring box or the slide frame rotates in an opening or closing direction of the spring box or the slide frame.

13. The sliding nozzle device of claim 10, wherein a rack gear is mounted on and along the slide axle;

a pinion gear is mounted on a press screw, the pinion gear engaging with the rack gear, the press screw compressing a spring placed inside the spring box or releasing the compression of the spring; and according to the movement of the slide axle, the press screw rotates to compress the spring or to release the compression of the spring.

14. The sliding nozzle device of claim 11, wherein a rack gear is mounted on and along the slide axle;

a pinion gear is mounted on a press screw, the pinion gear engaging with the rack gear, the press screw compressing a spring placed inside the spring box or releasing the compression of the spring; and according to the movement of the slide axle, the press screw rotates to compress the spring or to release the compression of the spring.

15. The sliding nozzle device of claim 12, wherein a rack gear is mounted on and along the slide axle;

a pinion gear is mounted on a press screw, the pinion gear engaging with the rack gear, the press screw compressing a spring placed inside the spring box or releasing the compression of the spring; and according to the movement of the slide axle, the press screw rotates to compress the spring or to release the compression of the spring.

16. The sliding nozzle device of claim 10, wherein the auxiliary plate-exchanging means has a contact portion to be contacted by the sliding means;

the sliding means operates in the second direction and contacts with the contact portion, and the slide axle moves in the second direction; and the auxiliary plate-exchanging means is connected to the sliding means by a connecting jig, thereby the sliding means operates in the first direction, and the slide axle moves in the first direction.

17. The sliding nozzle device of claim 11, wherein the auxiliary plate-exchanging means has a contact portion to be contacted by the sliding means;

the sliding means operates in the second direction and contacts with the contact portion, and the slide axle moves in the second direction; and the auxiliary plate-exchanging means is connected to the sliding means by a connecting jig, thereby the sliding means operates in the first direction, and the slide axle moves in the first direction.

18. The sliding nozzle device of claim 12, wherein the auxiliary plate-exchanging means has a contact portion to be contacted by the sliding means;

the sliding means operates in the second direction and contacts with the contact portion, and the slide axle moves in the second direction; and the auxiliary plate-exchanging means is connected to the sliding means by a connecting jig, thereby the sliding means operates in the first direction, and the slide axle moves in the first direction.

* * * * *